US007605337B2

(12) United States Patent
Scherl et al.

(10) Patent No.: US 7,605,337 B2
(45) Date of Patent: Oct. 20, 2009

(54) SYSTEM

(75) Inventors: Josef Scherl, Neunburg (DE); Rudolf Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 593 days.

(21) Appl. No.: 11/509,602

(22) Filed: Aug. 25, 2006

(65) Prior Publication Data

US 2007/0137995 A1 Jun. 21, 2007

(30) Foreign Application Priority Data

Dec. 20, 2005 (EP) ..... 05027928

(51) Int. Cl.
*H01H 5/02* (2006.01)

(52) U.S. Cl. ..... 200/405; 200/16 A

(58) Field of Classification Search ..... 200/16 A–16 D, 200/43.04, 43.07, 402, 405, 409, 424, 440, 200/442, 447, 449, 450, 452, 453, 454, 457, 200/458, 334, 520, 329, 341
See application file for complete search history.

(56) References Cited

U.S. PATENT DOCUMENTS

| | | | | |
|---|---|---|---|---|
| 3,436,497 | A * | 4/1969 | Mading | 200/16 A |
| 4,306,123 | A * | 12/1981 | Taylor | 200/16 A |
| 4,634,820 | A * | 1/1987 | Noguchi | 200/16 A |
| 5,047,628 | A * | 9/1991 | Schmidt et al. | 250/229 |
| 5,360,954 | A * | 11/1994 | Bruggeman et al. | 200/524 |
| 5,569,890 | A * | 10/1996 | Olsen | 200/16 A |
| 6,198,058 | B1 * | 3/2001 | Graninger et al. | 200/50.02 |
| 6,376,785 | B1 * | 4/2002 | Graninger | 200/50.02 |
| 6,483,058 | B2 * | 11/2002 | Ehrensberger | 200/302.2 |
| 6,822,173 | B1 * | 11/2004 | Schafer | 200/16 A |
| 6,987,235 | B2 * | 1/2006 | Sambar et al. | 200/520 |
| 7,232,965 | B2 * | 6/2007 | Gibbons et al. | 200/17 R |
| 7,309,840 | B1 * | 12/2007 | Lo | 200/293 |

FOREIGN PATENT DOCUMENTS

| | | | |
|---|---|---|---|
| DE | 41 01 493 | C2 | 7/1992 |
| EP | 0 932 174 | A2 | 7/1999 |
| EP | 1 153 609 | A1 | 11/2001 |
| JP | 2003 272468 | A | 9/2003 |
| JP | 2003 303527 | A | 10/2003 |
| WO | WO 2004/023501 | A1 | 3/2004 |

OTHER PUBLICATIONS

European Search Report dated Apr. 28, 2006.

* cited by examiner

*Primary Examiner*—Michael A Friedhofer
(74) *Attorney, Agent, or Firm*—Harness, Dickey & Pierce, P.L.C.

(57) ABSTRACT

A system includes a control device including an actuator, a movement of which is adapted to cause a movement of an actuator plunger; and a switching element. The switching element includes a switch slide adapted to follow a movement of the actuator plunger; a first terminal and a second terminal; contacting members adapted to connect the first terminal to the second terminal; and contact breaking member adapted to disconnect the first terminal from the second terminal in response to an inward displacement of the switch slide exceeding a first distance. The switching element further includes a jump system, responsive to displacement of the switch slide, adapted to bring the contacting members together to connect the first terminal to the second terminal if the inward displacement of the switch slide exceeds a second distance that is less than the first distance.

20 Claims, 7 Drawing Sheets

SYSTEM

PRIORITY STATEMENT

The present application hereby claims priority under 35 U.S.C. §119 on European patent application number EP05027928 filed Dec. 20, 2005, the entire contents of which are hereby incorporated herein by reference.

FIELD OF THE INVENTION

The described embodiments generally relate to the technical field of control devices and switching elements, in particular systems including both a control device and a switching element.

BACKGROUND

Many machines and electrical installations can be controlled via control devices, especially via control devices like push-buttons or mode switches. Control devices are usually modularly constructed, including an actuator, a mounting part such as a ring nut or an assembly holder, so that they can be connected to one or more switching elements that are implemented as normally open contacts (make contact elements) or as normally closed contacts (break contact elements). A control device and a switching element may then be installed into a control panel or a control board, for example.

An actuator is usually installed into a control panel or control board by bringing it through an opening on the front side of the control panel or control board and then installing it from behind by using a mounting part. The switching elements are connected to the actuator or to the mounting part mechanically, such as with screws, snap-on mounting or latches. The electrical connection between the switching elements and the control system is then made over the connecting terminals.

In security applications, such as in emergency off control devices, standard specifications may make it necessary to generate a control signal by using contacts with positive opening operation. Thus, in a non-actuated emergency off control device, the contacts and thereby the corresponding current circuit are closed. In case of a disturbance or if necessary, by actuating the emergency off actuator, usually located in front of the control panel or control board, a normally closed contact is opened and the electrical installation or machine has to be brought to a secured state. The opening of the normally closed contact is possible only if a correct spatial arrangement between the actuator and the switching element has been ensured. Because of improper installation or exposure to impacts, it may happen that a switching element has been mechanically separated from the actuator. In such a case, the emergency off control device does not operate properly any more, meaning that by activation if necessary, the normally closed contacts are not opened any more and the elimination of security risks cannot be guaranteed. This can lead to fatal damages to individuals and machines. This error cannot be detected by signaling, since if the switching element is spatially separated from the actuator, the normally closed contacts remain closed.

Furthermore, since switching elements are usually located behind a control panel or a control board or in a housing, they are not visible and therefore cannot be detected by the technical staff using the machine or installation. In particular applications, a switching element cannot be mechanically secured to the actuator. This would be the case if in a housing the switching element and the wiring were mounted onto floor (e.g. on a top-hat rail) and the actuator were fastened at the cap. Here that the spatial arrangement between the actuator and switch would be proper depends on whether or not the cap has been closed properly. If in an actuated emergency off control device the cap of the housing or the switch panel door is opened, the normally closed contacts that have been opened by actuating the control device are closed again and the emergency off command is thus overridden, which may have adverse consequences especially if this happens together with a further error.

Published U.S. Pat. No. 6,198,058 and German patent 4,101,493 both disclose switching systems for identifying or avoiding the error discussed above. The systems disclosed in them include normally closed contacts and normally open contacts. Here the switch slide is adapted, if the switching elements are properly installed to the actuator, to close the normally open contact, but not that much that the normally closed contact would be opened. If the normally open contacts and the normally closed contacts are installed in series, and if the spatial arrangement of the switching elements and the non-actuated actuator is appropriate, the current circuit is closed.

By actuating the emergency off control device, the normally closed contact is opened and the current circuit will be broken despite the still closed normally open contact. If the switching element is, for any reason, disengaged, the partly pre-stressed switch slide moves because of the spring force into its initial position and the current circuit is broken because the normally open contact is opened.

The English abstract of JP 12003-2722468 discloses a mounting mechanism for a control device. The switching element mounted on a support is mounted to the actuator by way of a turn-lock fastener. The turn-lock fastener is adapted to open the normally closed contact in all positions except the interlocking position. If the turn-lock fastener is in the interlocking position so that the switching element is not properly connected to the actuator, the normally closed contact remains closed, even though the spatial arrangement of the switching element and actuator is not correct. Thus, it cannot be guaranteed that the corresponding switching element is really ready for operation if the emergency-off current circuit is closed.

The English abstract of JP 12003-303527 discloses a switch slide that, carrying a movable contact member, is connected in a form-locking manner to the plunger of the actuator. If this contact is missing, the normally closed contact is opened by a spring that applies a force on the switch actuator in a direction opposite to the movement. Similar kind of functionality is used also in EP 1 1153 609 A1, whereby the connection between the switch actuator and plunger is obtained by way of a bayonet joint.

SUMMARY

The safety problem that disengagement of a switch from the control device may cause can be improved upon or even solved with the system of at least one embodiment.

A system, in at least one embodiment, that in addition to i) a control device comprising an actuator, the movement of which is adapted to cause a movement of an actuator plunger, and ii) a switching element comprising a switch slide adapted to follow a movement of the actuator plunger, a first terminal and a second terminal, contacting members adapted to connect the first terminal to the second terminal and contact breaking member adapted to disconnect the first terminal from the second terminal in response to an inward displacement of the switch slide exceeding a first predefined distance, also includes a jump system responsible to displacement of the switch slide, adapted to bring the contacting members together to connect the first terminal to the second terminal if the inward displacement of the switch slide exceeds a second predefined distance that is less than the first predefined distance, may improve reliability and safety of the system especially against improper installation, since without the jump system bringing the contacting members together the first terminal would not be connected to the second terminal.

If the jump system, in at least one embodiment, is further adapted to bring the contacting members apart from each other to disconnect the first terminal from the second terminal in response to the inward displacement of the switch slide being less than a third predefined distance, the reliability and safety of the system may be improved especially against errors that may happen if the switching element and the control device get disengaged. This can be carried out particularly advantageously, in at least one embodiment, if the third predefined distance is less than a displacement caused by mechanical connection between the control device and the switching element if the control device and the switching element are properly connected to each other, since an improper connection between the control device and the switching element may cause a smaller displacement, which thus can be detected easier.

If the jump system, in at least one embodiment, is further adapted to allow the contacting members to remain together if the inward displacement of the switch slide exceeds the third predefined distance but is less than the first predefined distance, thus adapted to keep the first terminal connected to the second terminal, the movement range of the actuator in an non-actuated state can be increased, thus reducing the probability of opening the opening circuit by mistake.

If the control device, in at least one embodiment, is adapted to cause an inward displacement of the switch slide having a magnitude of a fourth predefined distance when the control device is connected with the switching element directly or indirectly when the actuator is not actuated or its initial state, the required displacement of the switch slide can be guaranteed when the control device is properly connected with the switching element and is in the initial state.

If the switching element, in at least one embodiment, includes a first stopper and a second stopper, and the jump system is adapted to remove a contact bridge that resides on the first stopper and on the second stopper in response to the inward displacement of the switch slide exceeding the second predefined distance, improved support for the contact bridge may be ensured.

If the switching element, in at least one embodiment, includes a third terminal electrically connected to the first stopper, and a fourth terminal electrically connected to the second stopper, and if the contact bridge is adapted to connect the third terminal to the fourth terminal when the contact bridge resides on the first stopper and on the second stopper, the system can be used to give information to a control or signaling circuit.

If the first stopper or the second stopper is a resilient stopper, especially a stopper spring, the maximum opening between the stoppers and the contact member can be made larger.

If the system, in at least one embodiment, further includes a normally closed switching element installed next to the switching element, or on top or below the switching element, the normally closed switching element comprising a first terminal and a second terminal, and if in the system the actuator plunger of the control device is adapted to move the switch slide of the switching element and the switch slide of the normally closed switching element in response to a movement of the actuator, the opening circuit does not need to be opened only because the connection between the control device and the switching element fails, since the monitoring or signaling circuit will can detect this reliably.

If the control device, in at least one embodiment, is an emergency off push-button or mode switch, an emergency off-command may be generated both upon inappropriately assembling the emergency off control device and in response to manually actuating the actuator, such as in emergency.

BRIEF DESCRIPTION OF THE DRAWINGS

In the following, two embodiments of a system including a control device and a switching element will be described in more detail with reference to the accompanying drawings in FIGS. 1A to 6, of which.

Same reference numerals refer to similar structural elements throughout the description.

DETAILED DESCRIPTION OF THE EXAMPLE EMBODIMENTS

Figure 1A:
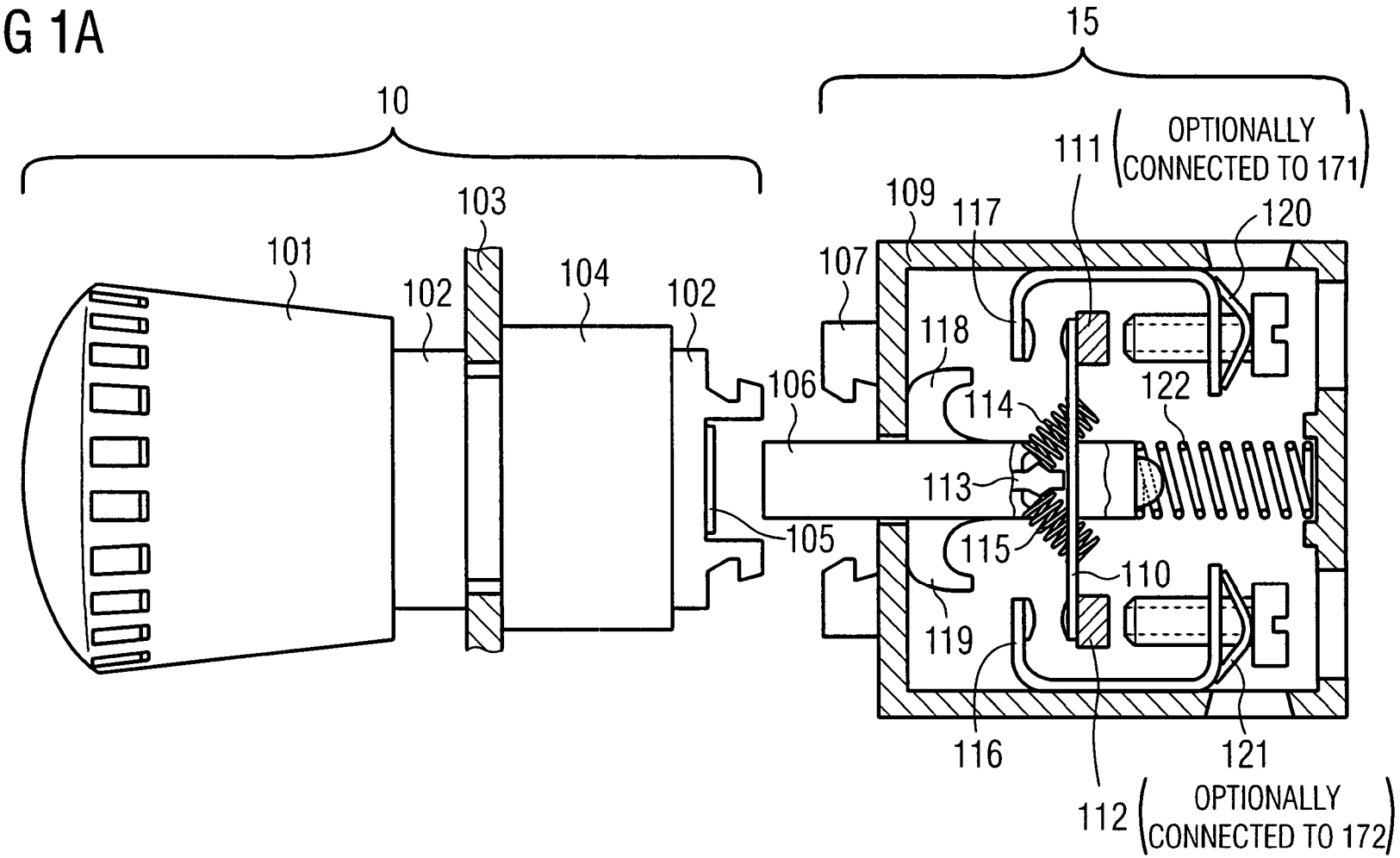
FIG. 1A shows a control device installed into a control panel or control board and a switching element not yet connected to the control device.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

FIG. 1A shows a control device 10 that has been installed into a control panel or control board 103. The body 102 of the control device 10 has been brought through an opening in the control panel or control board 103 and then fastened with a mounting support 104. The control device 10 comprises an actuator 101, the movement of which causes movement of the actuator plunge 105. The actuator plunge 105 and the actuator 101 may consist of one part or may be joined to each other or otherwise so arranged that the actuator plunge 105 follows movement of the actuator 101.

FIG. 1A shows also a switching element 15. The switching element 15 comprises a first terminal 120 and a second terminal 121, and optionally also a third terminal 171 and a fourth terminal 172.

The first terminal 120 and the second terminal 121 are connected to the opening circuit; if the first terminal 120 and the second terminal 121 are electrically connected to each other and if there are no breaks in the opening circuit, the opening circuit is closed. If the first terminal 120 and the second terminal 121 are disconnected from each other, the opening circuit is broken.

The switching element 15 is adapted to connect the first terminal 120 to the second terminal 121 and to disconnect the first terminal 120 from the second terminal 121 responsive to state of the control device 10.

The third terminal 171 and the fourth terminal 172 may be similar to the first and the second terminal 120, 121, but they are preferably connected to a control or signaling circuit.

The switching element 15 may be adapted to connect the third terminal 171 to the fourth terminal 172 and to disconnect the third terminal 171 from the fourth terminal 172 responsive to state of the control device 10.

Figure 1B:
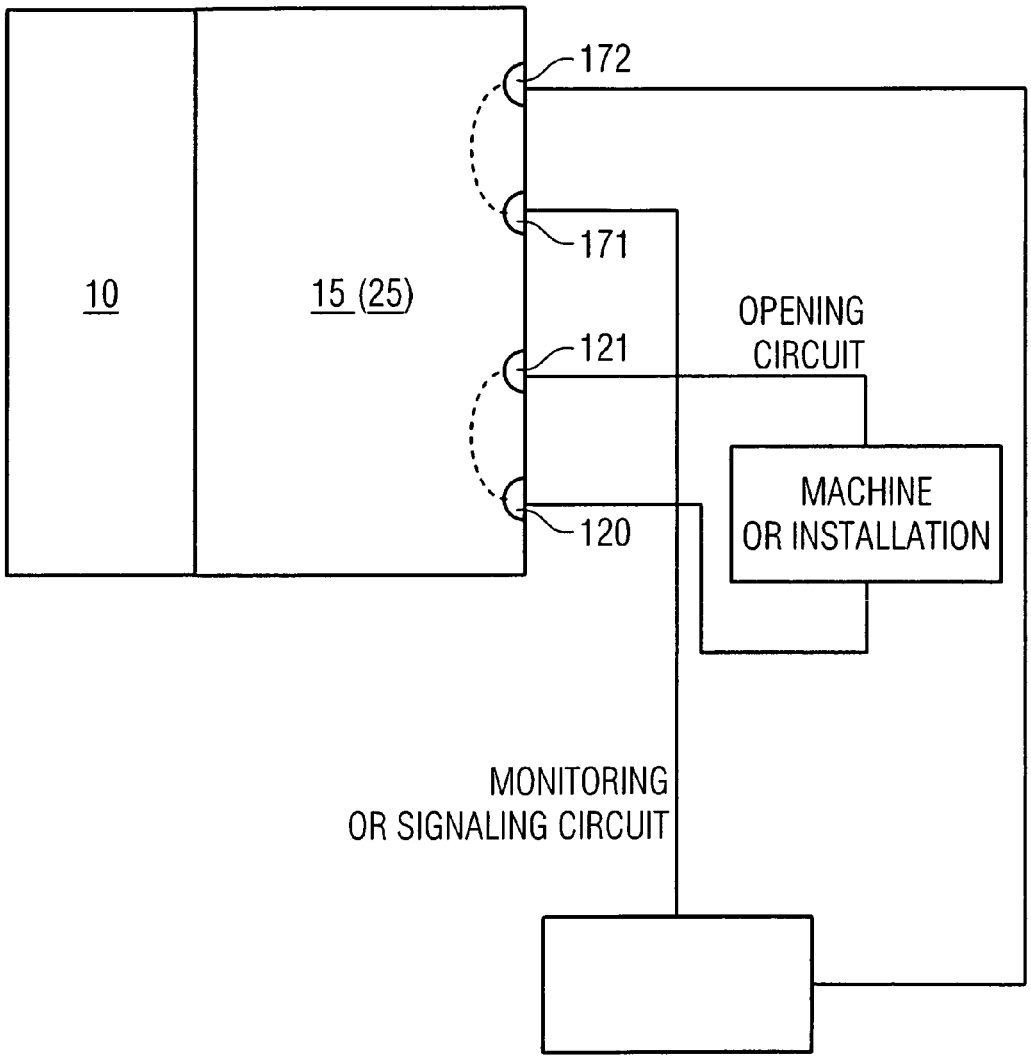
FIG. 1B illustrates the opening circuit and the monitor or signaling circuit.

The opening circuit and the monitor or signaling circuit in connection to the system have been illustrated in more detail in FIG. 1B.

The switching element 15 may be connected mechanically, preferably by screwing or snapping, indirectly through the mounting support 104 to the control device 10, or directly to the control device 10. When the switching element 15 is brought to the control device 10 during installation, the switch slide 106 is pressed against the control device 10.

In response to the switch slide 106 being slightly depressed, the jump system comprising bearing 113, and springs 114, 115 will first lift the contact bridge 110 that resides on stoppers 111, 112.

Figure 2:
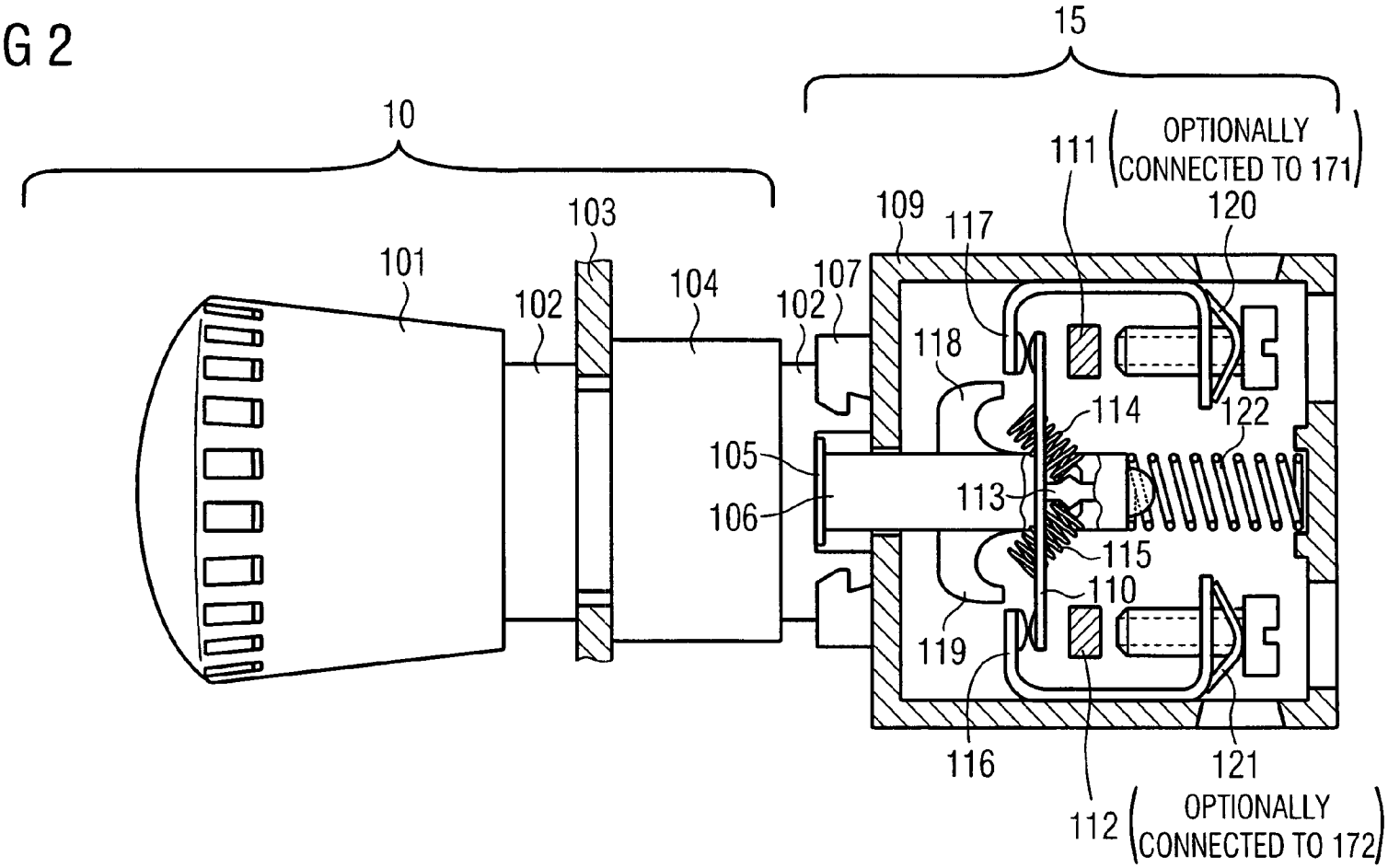
FIG. 2 shows a system including a switching element connected to a control device, the system being in its initial state and ready to operate.

Upon the switch slide 106 being depressed further, the jump system sets the contact bridge 110 to connect the contact members 116, 117 to each other, thereby connecting the first terminal 120 to the second terminal 121. Because by further depression of the bearing, the force caused on the contact bridge 110 by the compression springs 114, 115 of the jump system is reversed, causing the contact bridge 110 to jump against the contact members 116, 117, closing the current circuit between terminals 120, 121 in a spring-loaded manner; the system would now be in its initial state and ready to operate, as shown in FIG. 2.

Figure 3:
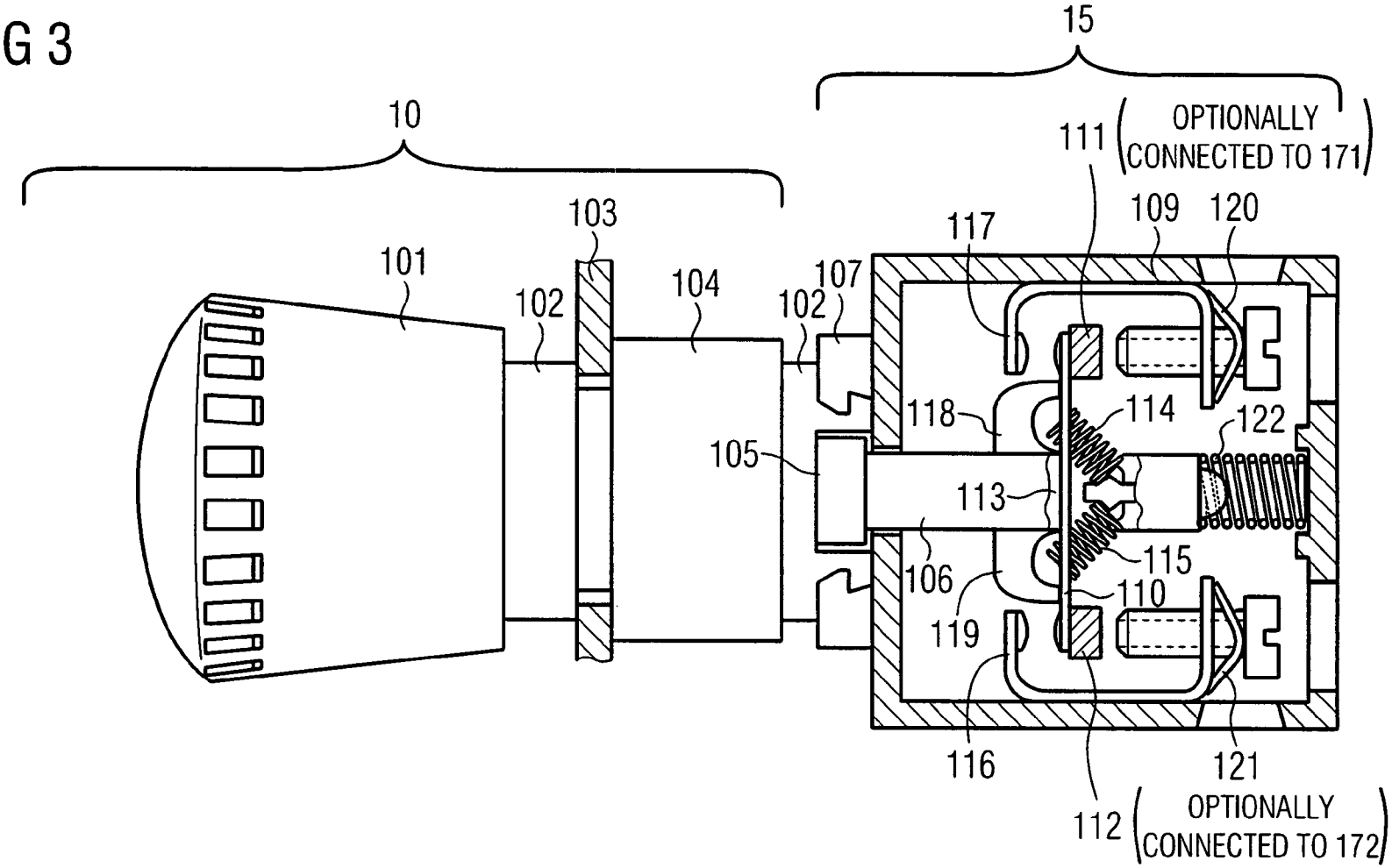
FIG. 3 shows the system of FIG. 2 after the command device has been activated and the switching element has opened the opening circuit.

When the switch slide 106 is depressed further, the contact breaking member, such as the contact breaker bow 118, 119, breaks the contact between the contact members 116, 117, preferably by displacing the contact bridge 110, thus breaking the current circuit between terminals 120, 121 with a positive opening force, as shown in FIG. 3.

In designing the system, the three phases (lift-connect-break contact) in the action of the switching element 15 may be adapted to ensure that the opening circuit is closed only when the switching element 15 and the control device 10 are appropriately connected to each other. The depression of the switch slide 106 caused by connecting the control device 10 with the switching element 15 causes a pretension in the return spring 122 and preferably also in the jump system. The relaxation of the pretension promotes the outward movement of the switch slide 106 when the connection between the control device 10 and the switching element 15 disappears.

When a non-actuated control device 10 is connected to a switching element directly or indirectly, the control device 10 may be adapted to cause the lifting and the connecting.

Alternatively, the non-actuated control device 10 may be adapted to cause the lifting only. Then it would be necessary to actuate the actuator 101 once fully and then return the actuator to the initial (non-actuated) state, or instead of fully actuating the actuator 101, the actuator 101 may be slightly depressed in order to cause the connecting.

Would the intended configuration of the system get disturbed for any reason, e.g. because of inappropriate mounting between the switching element 15 and the control device 10 or because of impact of external forces resulting in incorrect fitting or disappearing of the switching element 15, the current circuit between the terminals 120, 121 would be broken since the return spring 122 would push the switch slide 106 and therefore also the bearing 113 to push the contact bridge 110 away from the contact members 116, 117 in the other direction, thus resulting in the contact bridge 110 jumping back to the stoppers 111, 112.

To better fulfill the functions mentioned above, the, compression springs 114, 115 and the return spring 122 are preferably adapted to ensure both that there is sufficient contact force between the contact members 116, 117 and the contact bridge 110 in the operating state and that this contact force does not make it impossible to reliably displace the switch slide 106. The return spring 122 should be able to reliably overcome the directional component of the total spring force of the jump system, also at its maximum, and additionally to move out the switch slide 106 so that the jump system performs a jumping back.

To obtain the jumping property, it is not necessary to use compression springs 114, 115, but also other kinds of spring elements, especially leave springs, can be used.

Figure 5:
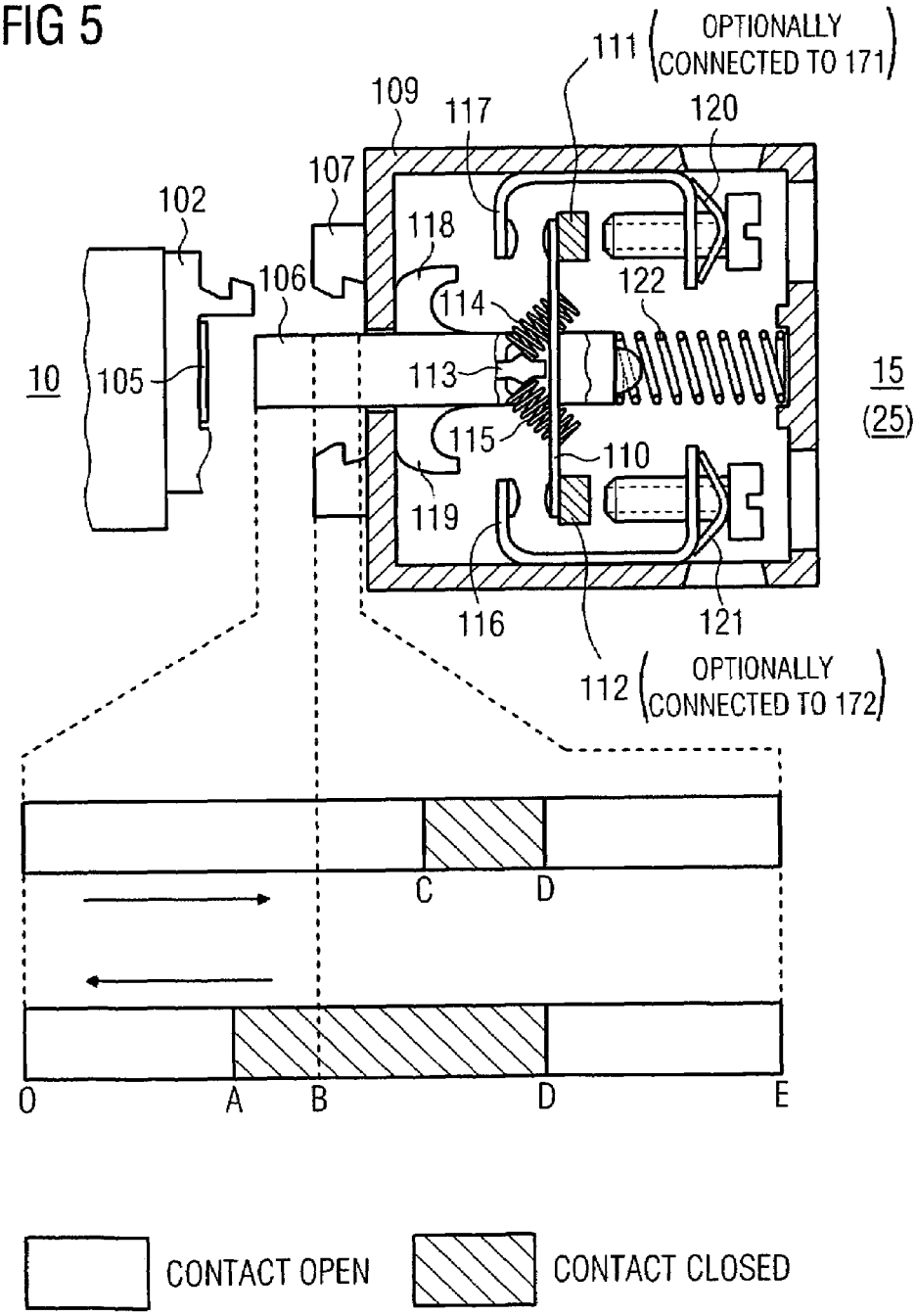
FIG. 5 illustrates the operating principle of the system.

The system can provide further advantages, depending on the geometrical configuration of the switching element 15, on the fixed and movable elements, and on the relative position of the control device 10 to the switching element 15. Some of these advantages are discussed with reference to illustration in FIG. 5, where the control device 10 is shown not as mounted to the switching element 15 for the sake of clarity.

In the absence of the control device 10, the switch slide 106 preferably extends from the switch housing 109, the extension is preferably promoted by the return spring 122. The current circuit between terminals 120, 121 is broken, thus causing the opening circuit to be open.

When the switching element 15 is coupled to a non-activated control device 10, the switch slide 106 is slightly depressed by the control device until point B. The dimensioning of the switching element 15, especially of the switch slide 106 and of the bearing 113, of the contact bridge 110 and of the contact members 116, 117 together with the dimensioning of the control device 10, especially of the actuator plunger 105, is adapted not to cause the jumping of the contact bridge 110 yet, i.e. the current circuit between terminals 120, 121 stays open and therefore also the opening circuit being open.

In response to further depressing the actuator 105, the switch slide 106 moves beyond point C, the bearing 113 of the jump system turns the compression springs 114, 115 of the jump system and passes the contact bridge 110 so that the spring force contributes to jumping of the contact bridge 110 from the stoppers 111, 112 onto the contact members 116, 117, thus closing the current circuit between terminals 120, 121 and therefore closing the opening circuit.

By further depressing of the switch slide 106 beyond point D, possibly until point E, the contact bridge 110 is positively opened (forced by elements assembled in form-locking manner) as required by technical specifications, therefore opening the current circuit between terminals 120, 121 and therefore opening the opening circuit.

When the actuator 101 is returned towards its initial position 0, the switch slide 106 follows the actuation plunger 105 promoted by the return spring 122. When the switch slide 106 reaches point D, the current circuit between terminals 120, 121 is closed therefore closing the opening circuit. Even though the switch slide 106 moves further to point B, the jump system does not make the contact bridge 110 to jump back. The distances from contact member 116 to stopper 112 and from contact member 117 to stopper 111 and their positions to the bearing 113 are preferably so dimensioned that there would be jumping back at point A only.

As long as the switching element 15 is appropriately connected to the command device 10, point A cannot be reached, since in normal use the switch slide 106 can be moved back and forth between points B and E only. Only when the switching element 15 is removed—intentionally or not—from the control device 10, point A can be passed and the current circuit between terminals 120, 121 would be broken and the opening circuit would be opened. To have the switching element 15 to be ready to operate and to have the current circuit between terminals 120, 121 closed, it is enough to activate the control device 10 once after the installation by moving the actuator 101 to cause the switch slide 106 to move beyond point C and then to return the switch slide 106 back to the initial state between D and B by returning the actuator 101. In this manner it can be guaranteed that a system comprising the control device 10 and the switching element 15 has been at least so installed that the actuator 105 can move the switch slide 106.

In other words, the jumping points and thereby also the switching points and switching paths can be so selected that the current circuit between the first terminal 120 and the second terminal 121 is closed only when the control device 10 has been appropriately connected to the switching element 15. When the system is disassembled, the contact between the contact members 116, 117 and the contact bridge 110 may be spring-loaded, and when the emergency off command has been given, the contact between the contact members 116, 117 and the contact bridge 110 may be opened in a form-locking manner.

The skilled person appreciates that points B and C may overlap, meaning that the jump system in the switching element 15 may be adapted to lift the contact bridge 110 and to connect the first terminal 120 to the second terminal 121 in response to an appropriate connection between the control device 10 and the switching element 15.

FIGS. 1A, 2 and 3 represent embodiments where the maximal opening between the contact members 116, 117 and the contact bridge 110 is limited with actuation of the control device 10 by stoppers 111, 112 that are rigid. Under consideration of tolerances of the switch element 15 and the command device 10, for security reasons as large maximum opening as possibly would be desirable.

Figure 4:
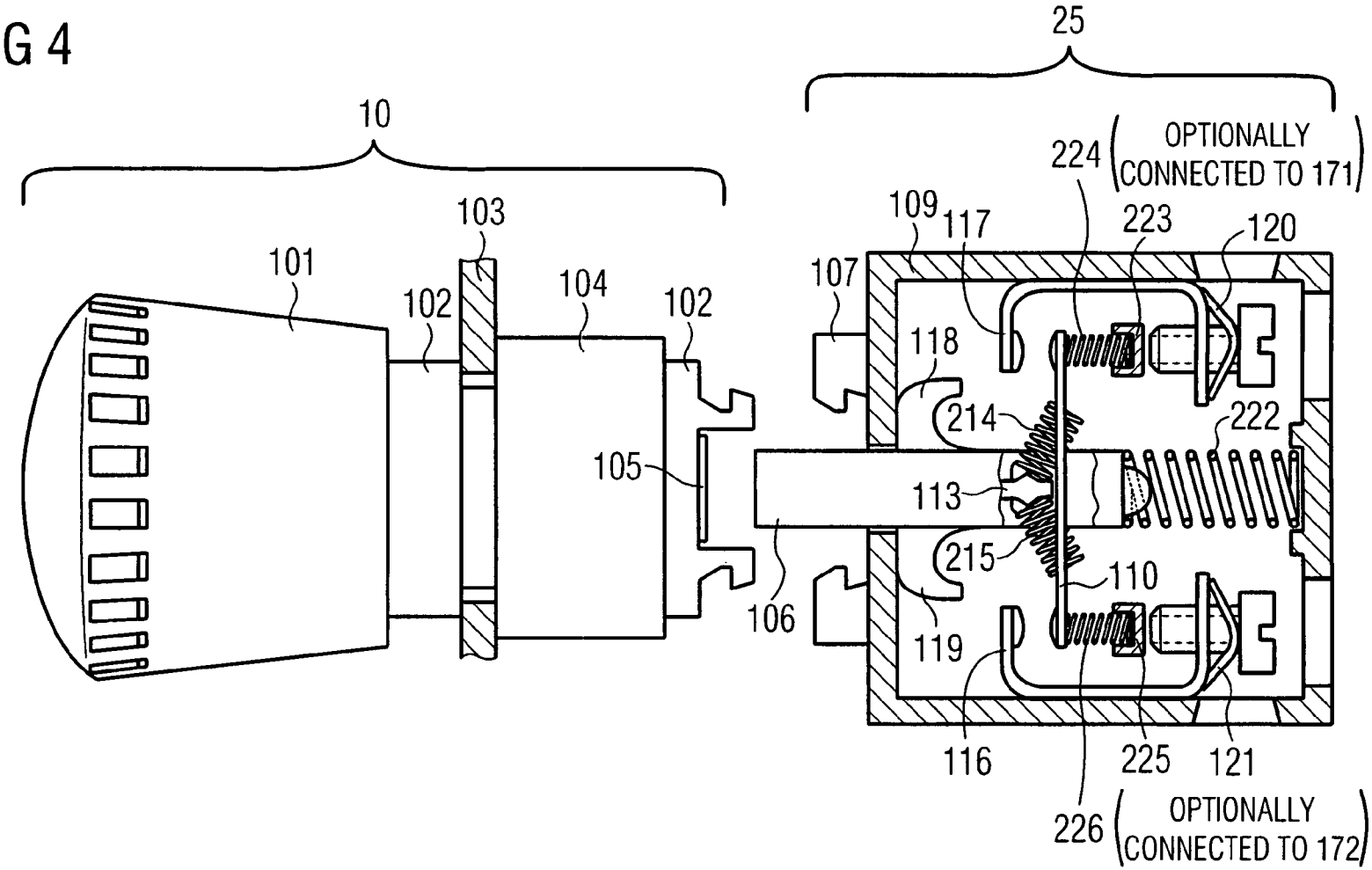
FIG. 4 shows an embodiment of the system where the maximum opening between the contact bridge and the contactors has been extended in the switching element.

The maximum opening can, as illustrated in the alternative embodiment of the switching element 25 in FIG. 4, be enlarged by replacing preferably all but at least some of the rigid stoppers 111, 112 with resilient stoppers, such as with stopper springs 224 and 226. If the resilient stoppers are stopper springs 224, 226, they are preferably assembled on spring fixtures 223, 225, respectively. By actuating the switch slide 106 by the control device 10, the jumping of the contact bridge 110 follows when the spring force caused by the resilient stoppers is larger than the axial component of the force of compression springs 214, 215 of the jump system. The switching element 25 can be so dimensioned that in response to actuation of the control device 10, with compression of the stopper springs 224, 226 a larger maximum opening can be achieved. The switching element 15 as shown in FIGS. 1A, 2 and 3 and in FIG. 5 can be replaced with the switching element 25. Since the resilient stoppers cause an additional spring force, the dimensioning of the return spring 222 may be different from that of the return spring 122; the relaxation of the pretension of the return spring 222 is adapted to promote the outward movement of the switch slide 106 when the connection between the control device 10 and the switching element 25 would disappear.

The stoppers 111, 112 as illustrated in FIGS. 1A, 2 or 3 can be adapted to work as contacts for a monitoring or signaling circuit that can be contacted to a control system through terminals 171, 172. If the switch element 15 is separated from the control device 10 and the switch slide 106 is not actuated, the contact bridge 110 leans on the contact members 116, 117 and the current circuit between terminals 120, 121 is then closed. If the switching element 15 is appropriately mounted to the control device 10, the switch slide 106 is actuated that much, in a manner described above, that the contact bridge 110 jumps and the current circuit between terminals 120, 121 is closed. At the same time, the monitoring or signaling circuit between the other terminals 171, 172 is opened.

The complete system can be so dimensioned that by actuation of the control device 10 the current circuit between terminals 120, 121 is opened but the contact bridge 110 is not moved that far that the monitoring or signaling circuit between the other terminals 171, 172 would be closed. Thereby the following operating states can be recognized:

- Opening circuit closed, monitoring or signaling circuit open
  - Switching element 15 (or 25) is appropriately connected to the control device
  - Switch slide 106 not actuated and therefore control device 10 not actuated
- Opening circuit open, monitoring or signaling circuit closed
  - Switch slide 106 not actuated
  - Switching element 15 not appropriately connected to the control device 10
- Opening circuit open, monitoring or signaling circuit open
  - Control device 10 actuated
  - Opening circuit positively opened (forced to open)
  - Connection between the switching element 15 (or 25) and the control device 10 is in order Thus, in non-disturbed operation the monitoring or signaling circuit is always open. The control system can therefore so wired or programmed that by closed monitor or signaling circuit the installation or machine is set to a secured state or an alarm is triggered. If such separate contact bridges are used for the opening and the monitoring circuits that are mechanically coupled but electrically isolated from each other, the contact separation of both circuits can be achieved.

Figure 6:
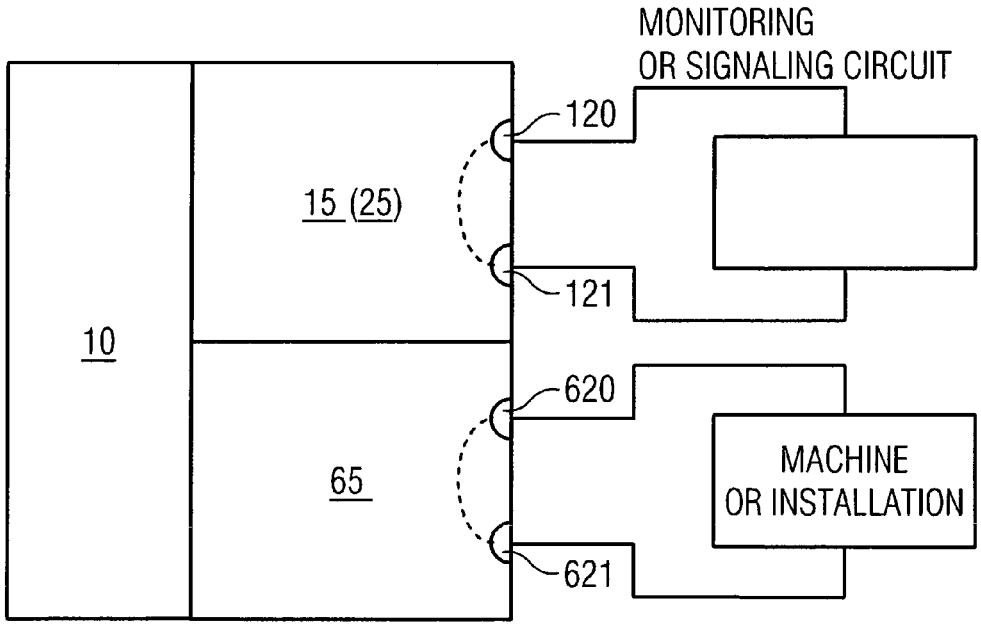
FIG. 6 illustrates a further embodiment of the system.

FIG. 6 illustrates a further embodiment of the system. Now the system includes in addition to a control device 10 and a switching element 15 or 25 also another switching element 65. In FIG. 6 the control device 10 is shown as connected to both switching elements 15 (or 25) and 65. To this end, the first switching element 15 (or 25) and 65 may be installed next to each other, or on top of each other, and they may be inside one casing or both in separate casings.

The actuator 101 of the control device 10 is adapted to cause a movement of the actuator plunge 105 in response to the actuator handle being moved, and the actuator plunge 106 is adapted to move the switch slide of switching element 15 (or 25) and the switch slide of the switching element 65. At least two terminals 120, 121 of the switching element 15 (or 25) are connected to the monitoring or signaling circuit. At least two terminals 620, 621 of the switching element 65 that is a normally closed switching element are connected to the opening circuit. In this manner, the opening circuit does not need to be opened only because the connection between the control device 10 and the switching element 15 failed, but the monitoring or signaling circuit can reliably detect this.

Even though the invention has been disclosed using particular embodiments of the system as examples, the skilled person appreciates that the scope of the invention is not limited by these examples but by the scope of the accompanying claims. In particular, the movement of the actuator plunger may but does not be caused by a translational movement of the actuator, but instead or in addition may result from a rotational movement of the actuator. The movement of he actuator plunger may be translational or rotational, or a combination thereof.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE NUMBERS

10 control device
15, 25 switching element
101 actuator
102 body of the control device
103 control panel or control board
104 mounting support
105 actuator plunger
106 switch slide
107 hook of the snap-on mounting latches
109 switch housing
110 contact bridge
111 stopper
112 stopper
113 bearing
114 compression spring of the jump system
115 compression spring of the jump system
116 contact member
117 contact member
118 contact breaker bow
119 contact breaker bow
120 terminal
121 terminal
122 return spring
171 terminal
172 terminal
222 return spring
223 spring fixture
224 stopper spring
225 spring fixture
226 stopper spring

What is claimed is:

1. A system comprising:

a control device including an actuator, a movement of which is adapted to cause a movement of an actuator plunger; and a switching element including, a switch slide adapted to follow a movement of the actuator plunger, a first terminal and a second terminal, contacting members adapted to connect the first terminal to the second terminal, contact breaking member adapted to disconnect the first terminal from the second terminal in response to an inward displacement of the switch slide exceeding a first distance, and a jump system responsive to displacement of said switch slide, the jump system adapted to bring the contacting members together to connect the first terminal to the second terminal if the inward displacement of said switch slide exceeds a second distance that is less than the first distance.

2. A system according to claim 1, wherein the jump system is further adapted to bring the contacting members apart from each other to disconnect the first terminal from the second terminal in response to the inward displacement of said switch slide being less than a third distance that is less than said second distance.

3. A system according to claim 2, wherein the control device is adapted to cause an inward displacement of said switch slide having a magnitude of a fourth distance when the control device is connected with the switching element directly or indirectly when the actuator is at least one of not actuated and its initial state.

4. A system according to claim 3, wherein the fourth distance is larger than the third distance but less than the second distance.

5. A system according to claim 4, wherein the switching element includes a first stopper and a second stopper, and wherein the jump system is adapted to remove a contact bridge that resides on the first stopper and on the second stopper in response to the inward displacement of said switch slide exceeding said fourth distance.

6. A system according to claim 3, wherein the switching element includes a first stopper and a second stopper, and wherein the jump system is adapted to remove a contact bridge that resides on the first stopper and on the second stopper in response to the inward displacement of said switch slide exceeding said fourth distance.

7. A system according to claim 6, wherein the switching element includes a third terminal electrically connected to said first stopper, and a fourth terminal electrically connected to said second stopper and wherein the contact bridge is adapted to connect the third terminal to the fourth terminal when the contact bridge resides on the first stopper and on the second stopper.

8. A system according to claim 7, wherein at least one of said first stopper and said second stopper is a resilient stopper.

9. A system according to claim 6, wherein at least one of said first stopper and said second stopper is a resilient stopper.

10. A system according to claim 9, wherein said resilient stopper is a stopper spring.

11. A system according to claim 2, wherein the third distance is less than a displacement caused by mechanical connection between the control device and the switching element if the control device and the switching element are properly connected to each other.

12. A system according to claim 2, wherein the jump system is further adapted to allow the contacting members to remain together if the inward displacement of said switch slide exceeds the third predefined distance but is less than the first predefined distance, thus adapted to keep the first terminal connected to the second terminal.

13. A system according to claim 2, wherein said control device is an emergency off push-button or mode switch.

14. A system according to claim 1, wherein the jump system is further adapted to allow the contacting members to remain together if the inward displacement of said switch slide exceeds the third predefined distance but is less than the first predefined distance, thus adapted to keep the first terminal connected to the second terminal.

15. A system according to claim 1, wherein the switching element further includes a resilient return member adapted to promote outward movement of said switch slide.

16. A system according to claim 1, further comprising:

a normally closed switching element installed at least one of next to the switching element, on top of the switching element and below the switching element, the normally closed switching element including a first terminal and a second terminal, wherein the actuator plunger of the control device is adapted to move the switch slide of the switching element and the switch slide of the normally closed switching element in response to a movement of the actuator.

17. A system according to claim 1, wherein said control device is an emergency off push-button or mode switch.

18. A system according to claim 1, wherein the control device is adapted to cause an inward displacement of said switch slide having a magnitude of a third distance when the control device is connected with the switching element directly or indirectly when the actuator is at least one of not actuated and its initial state.

19. A system comprising:

a control device including an actuator, a movement of which is adapted to cause a movement of an actuator plunger; and a switching element including, slide means for following a movement of the actuator plunger, a first terminal and a second terminal, means for connecting the first terminal to the second terminal, means for disconnecting the first terminal from the second terminal in response to an inward displacement of the slide means exceeding a first distance, and means, responsive to displacement of said slide means, for bringing the means for connecting together to connect the first terminal to the second terminal if the inward displacement of said slide means exceeds a second distance that is less than the first distance.

20. A system according to claim 19, wherein the means for bringing is further for bringing the contacting members apart from each other to disconnect the first terminal from the second terminal in response to the inward displacement of said slide means being less than a third distance that is less than said second distance.

* * * * *